US007496969B2

(12) United States Patent
Pieczynski

(10) Patent No.: US 7,496,969 B2
(45) Date of Patent: Mar. 3, 2009

(54) HEAT CONTAINMENT HAND WARMING DEVICE

(76) Inventor: Darren Edward Pieczynski, N9460 Koskela Rd., Wakefield, MI (US) 49968

( * ) Notice: Subject to any disclaimer, the term of this patent is extended or adjusted under 35 U.S.C. 154(b) by 624 days.

(21) Appl. No.: 11/114,506

(22) Filed: Apr. 25, 2005

(65) Prior Publication Data

US 2006/0248624 A1 Nov. 9, 2006

(51) Int. Cl.
*A41D 13/08* (2006.01)

(52) U.S. Cl. ..... 2/16; 234/578

(58) Field of Classification Search ..... 2/16, 2/159, 24, 69, 456; 128/879; 602/62, 63; 224/576, 578

See application file for complete search history.

(56) References Cited

U.S. PATENT DOCUMENTS 4,736,088 A * 4/1988 Bart ..... 219/211
4,899,749 A * 2/1990 Laroco ..... 607/111
5,139,187 A * 8/1992 Fowler ..... 224/576
5,615,769 A * 4/1997 Stephenson ..... 206/315.9
5,860,415 A * 1/1999 Waters ..... 126/680
6,613,953 B1 * 9/2003 Altura ..... 602/43
6,927,316 B1 * 8/2005 Faries et al. ..... 602/43

* cited by examiner

*Primary Examiner*—Tejash Patel
(74) *Attorney, Agent, or Firm*—Weiner & Burt, P.C.; Irving M. Weiner; Pamela S. Burt

(57) ABSTRACT

A heat containing hand warming device. The apparatus comprises a generally tubular muff with a hand warming chamber; an adjustable strap from the generally tubular muff; a snap for connecting and disconnecting the strap; auto sizing openings at the ends of the said hand warming chamber; a resealable pocket for belongings; and a resealable heat source chamber; a heat reflective layer encompassing the muff.

7 Claims, 2 Drawing Sheets

HEAT CONTAINMENT HAND WARMING DEVICE

BACKGROUND OF THE INVENTION

This invention relates generally to the field of hand muff devices, and more particularly to a heat containment apparatus to warm human hands.

The information provided below will address the current deficiencies and provide a solution for individuals to warm hands in cold weather.

Human hands are often exposed to cold weather while working or enjoying recreational activities. Gloves and mittens have been used to retain heat and shield the cold from effecting the function and pain associated with long exposure to the elements of cold weather. Gloves aid in retaining heat and shielding heat while allowing the use of each individual finger. Mittens keep hands warmer as the fingers are encompassed by the insulating material while the thumb is usually what becomes the most effected by the cold, as with individual fingers of the glove. Hand muffs have been used to allow the user to place both hands into an insulating device creating in essence a double mitten, thus keeping both hands even warmer.

U.S. Pat. No. 2,727,241 issued to Smith goes a step further with the hand muff to allow a pocket for traditional heat sources in the center of the muff. Giese, U.S. Pat. No. 2,835,896 states a hand warming muff including a neck strap and easy hand access. Kisnoshita, U.S. Pat. No. 3,793,643 created a carrier for a portable heat source where hands may then be inserted to warm. U.S. Pat. No. 4,221,954 issued to Cohen; Florence describes a heating element enclosed in a hand muff where the hands may grab a heat source.

Brock; Kenneth, U.S. Pat. No. 4,408,355 describes a hand muff that is semi rigid to conform to the body and allow one hand to be free when inserting the other.

All mentioned muffs provide means for hands to be insulated from the elements and some providing the use of additional heat sources though fail to create a muff to contain the heat and shield human order from exiting the muff that is important to hunters. There is also a need for a muff to utilize reuseable heat sources reducing waste into the environment and reduce overall cost of heating the hands in cold weather.

The information following will address the deficiencies in current hand muff devices and address the solutions to them.

BRIEF SUMMARY OF THE INVENTION

The primary object of the invention is a heat containment hand warming device.

Another object of the invention is to provide a chamber for a heat source inside the heat containment area.

A further with the object of the invention is variable openings at the ends of the heat containment warming device for hand insertion and sealing.

A further object of the invention is to be moisture resistant.

Another object of the invention is to posses a pocket for storage of the user's belongings.

Yet another object of the invention is to have human odor containtment or adsorbment properties.

A further object of the invention is to be secured to the waist with a connection snap on a strap variable in size.

Yet another object of the invention is variable in material color patterns and options of the exterior material.

In accordance with a preferred embodiment of the present invention, a heat containing hand warming device comprises an insulating heat reflective elongated generally tubular hand warming chamber; a connection means from the generally tubular hand warming chamber to itself that is adjustable in length and a disconnecting means; auto sizing openings at the ends of the said heat reflective elongated generally tubular hand warming chamber; a resealable pocket for belongings; and a resealable heat source chamber inside the said heat reflective elongated tubular hand warming chamber.

Other objects and advantages will become apparent from the following descriptions, taken in connection with the accompanying drawings, wherein, by way of illustration and example, an embodiment of the present invention is disclosed.

BRIEF DESCRIPTION OF SEVERAL DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
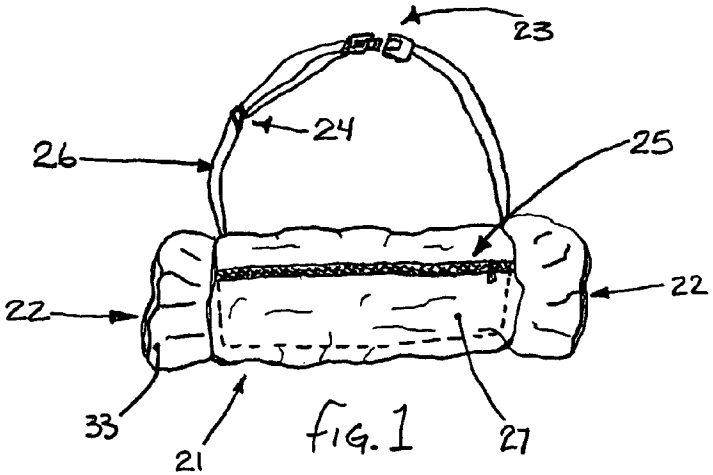
FIG. 1 is a perspective view of the preferred embodiment of the invention.

With reference to the drawings, a preferred embodiment is shown in FIG. 1. 21 is the generally tubular hand muff with hand insertion areas 22, located at opposite ends of the muff. 33 are elastic material ends to automatically seal around the wrists or forearms when the hands are inserted into the muff. The elastic is sewn on the inside of the outer shell material. 25 is a zipper to a pocket 27 on the front side of the muff for easy access to belongings being carried in the pocket 27. The pocket 27 runs the length of the hand warming chamber to be able to carry longer items such as game calls for hunters and tools for work purposes for example. The muff is strapped around the body at the waist by strap 26. An adjustable buckle 24 is used where the strap 26 is doubled between 24 and one end of snap 23. This allows the user to adjust one time for there body size and attach and detach the muff from the waist through the snap 23. The series of events to elongate or shorten the strap with a snap is well known in the art.

Figure 2:
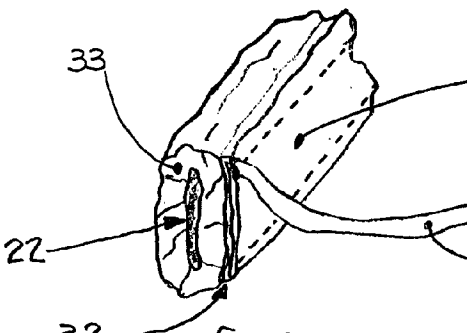
FIG. 2 is a side perspective view of the variable sized hand insertion point and heat source chamber.

FIG. 2 shows a left side view of the muff exposing the insertion area 22 to the warming chamber and 32 the opening to the heat chamber. 32 resides only on one side of the muff to reduce the openings to the heat chamber. 32 is easily opened and resealed using Velcro or hook and loop material. The heat chamber 31 is located at the back side of the muff. This places the heat against the body and more directly to the hands due to the heat reflective material in FIG. 3, 43.

Figure 2A:
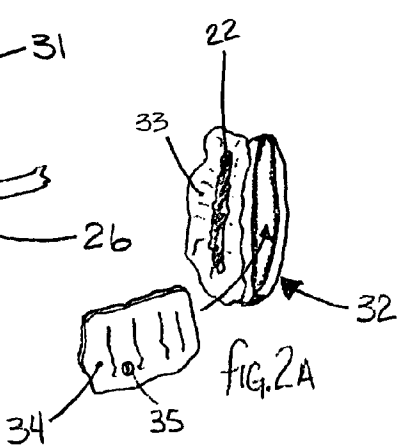
FIG. 2A is a side view enlarged showing resealable opening of the heat chamber and heat source insertion.

FIG. 2A is an enlarged view of the side of the muff with the resealable opening 32 behind hand insertion area 22 and the elastic material 33 to automatically seal the opening 22 when hands are inserted. 34 is a reusable heat source device and is inserted into heat chamber 32. 34 is made from liquid sour wax in a semi-transparent flexible enclosure. A perforated disc 35 is immersed inside the sour wax and flexible semi-transparent enclosure. When pressed/snapped the air vibrations start a chemical reaction and turns the sour wax hot. When insulated, the sour wax will stay warm for hours and then turn to a solid wax state. Another heat source may then replace the expired heat source. The expired reusable heat source can then be boiled for a short period of time to once again return to a liquid state and be reused hundreds of times. This is the preferred heat source as it is reusable, though other heat sources could be placed in the heat chamber 32 such as air activated disposable heat pouches, electric heat sources and self contained liquid burning heat sources and preheated sources.

Figure 3:
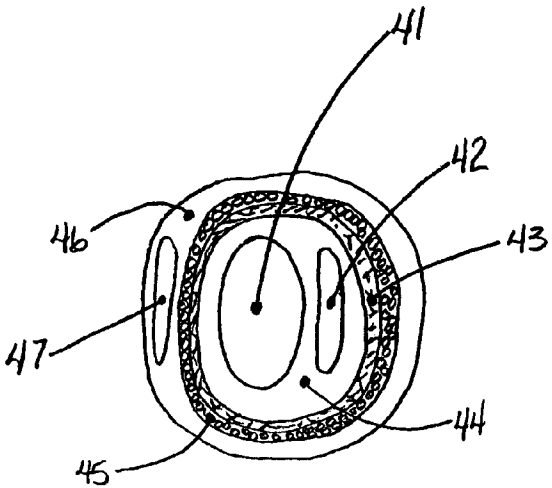
FIG. 3 is a cross sectional view of the preferred embodiment identifying layers of materials.

FIG. 3 explains further the separate chambers and layers of materials for the muff. 41 is the center hand warming chamber. 42 is the heat chamber. The heat chamber and hand warming chamber are surrounded with permeable insulation material to allow the heat to transfer from the heat chamber to the hand warming chamber and also insulate the hands from direct contact with the heat source. They both are then surrounded with heat reflective material 43, such as perforated metalized needlepoint insulation. Other features of the invention are that the muff posseses human scent containment or adsorbing materials. Layer 45 is the human scent lock layer. An example of this layer is carbon based material though all human scent locking materials may be utilized. The scent containment is key to hunters who want to be able to utilize there lightly gloved or bare hands to operate a firearm or archery equipment. Scent locking is key when hunting larger game. 46 outer layer is waterproof or water resistant insulating material surrounding pocket 47 and entire muff.

Figure 4A:
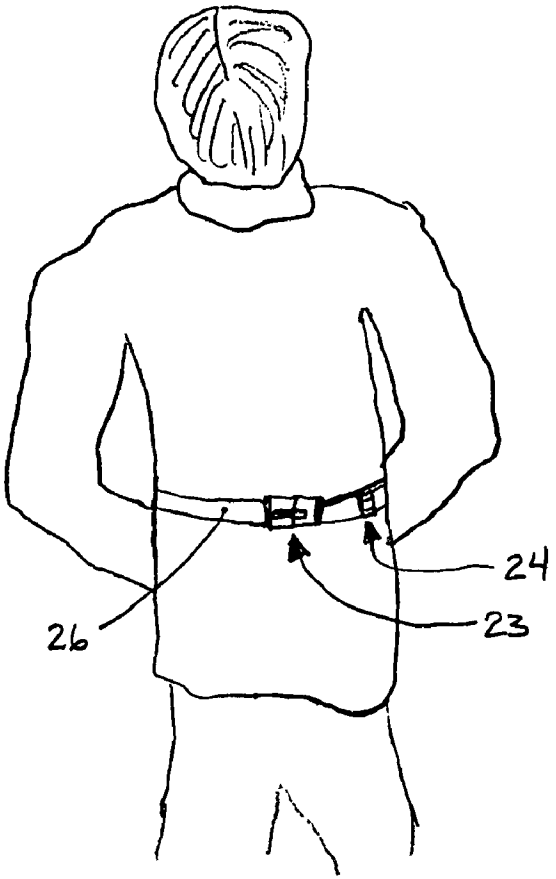
FIG. 4A shows the back view of the muff device.
Figure 4:
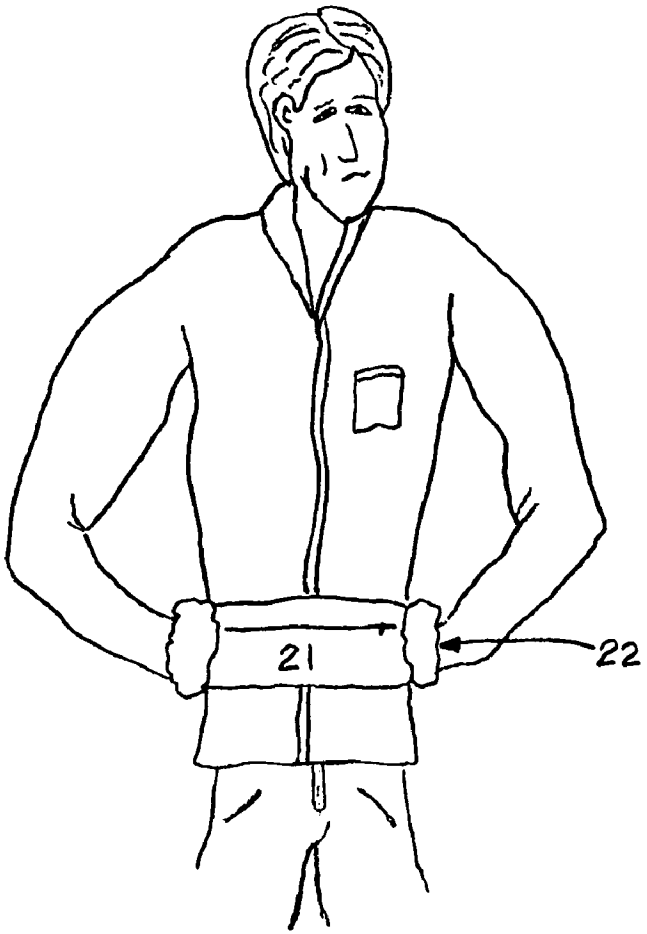
FIG. 4 shows the muff being worn with hands inserted in the hand insert areas.

FIG. 4 displays the muff 21 being worn with hands inserted in hand insert areas 22. FIG. 4A displays the back view of the muff device where strap 26 is around the waist of the user and 24 is preset to the proper size and 23 allows for quick snap connect and disconnect. The muff may also reside under the lower ends of the jacket when the muff is not needed for quick hand access. The muff can also be spun around the waist and reside on the back when not needed.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A heat containing hand warming device comprising:

a generally tubular muff made of layers of materials with a water resistant outer shell;

an insulated elongated generally tubular hand warming chamber which is located centrally within said generally tubular muff;

a resealable elongated heat source chamber which is located a fixed distance from said centrally-located insulated elongated generally tubular hand warming chamber;

said resealable elongated heat source chamber being located at a back side of said muff adjacent a body of a user of said device;

said resealable elongated heat source chamber being provided with only one opening therein to reduce openings in said heat source chamber;

a reusable heat source device inserted in said heat source chamber;

permeable insulation material surrounding said heat source chamber and said centrally-located hand warming chamber to allow heat to transfer from said heat source chamber to said hand warming chamber, and to insulate hands of the user from direct contact with said heat source device;

a generally tubular heat reflective layer surrounding said hand warming and heat source chambers the length of the said generally tubular muff;

a human scent lock layer surrounding said generally tubular heat reflective layer;

a pocket located outside of said human scent lock layer;

said pocket runs the length of said heat source chamber;

water resistant insulating material surrounding said human scent lock layer, said pocket, and the entire muff;

an adjustable strap attached to said generally tubular muff to allow an attachment means to the mid section of the body of the user;

a snap within said adjustable strap;

automatic size adjusting hand insert areas at the ends of the said insulated elongated generally tubular hand warming chamber; and said pocket being provided with opening and closing means.

2. The device as in claim 1 wherein:

said human scent lock layer comprises an encompassing layer of scent absorbing material which is a carbon based material.

3. The device as in claim 1 wherein:

said generally tubular muff includes outer material which is of variable color combinations and patterns.

4. A hand warming device, comprising:

first means for releasably accommodating hands of a user of the device;

a re-usable heat source;

said re-useable heat source comprises a flexible pocket containing a gel and a heat-initiating device which when activated initiates a chemical reaction in said gel which causes said gel to become warm and retain its warmth for hours;

upon initiation of said chemical reaction, said gel is transformed into a hot solid wax condition;

upon depletion of heat from said solid wax condition, said re-useable heat source can be boiled for a predetermined period of time to once again transform the gel into a liquid state for re-use;

second means for releasably holding said re-usable heat source;

said second means being disposed adjacent said first means and being positioned relative to said first means so that heat is transferred from said re-usable heat source to the hands of the user;

permeable insulation material which surrounds said first means and said second means and which allows heat to transfer from said second means to said first means and also to insulate the hands from direct contract with said second means;

heat reflective material which surrounds said permeable insulation material; and a layer of human scent containment or absorbing material surrounding said heat reflective material.

5. A hand warming device according to claim 4, including:

a pocket for accommodating belongings of the user;

said pocket being disposed remotely relative to said second means; and a waterproof and water-resistant insulating outer layer which surrounds said pocket and said layer of human scent containment or absorbing material.

6. A hand warming device according to claim 4, wherein:

said first means for releasably accommodating hands of the user of the device comprises a generally tubular hand muff with hand insertion portions disposed at opposite ends of said generally tubular hand muff.

7. A heat containing hand warming device, comprising:

a generally tubular muff made of layers of materials with a water resistant outer shell;

an insulated elongated generally tubular hand warming chamber which is located centrally within said generally tubular muff;

a resealable elongated heat source chamber which is located a fixed distance from said centrally-located insulated elongated generally tubular hand warming chamber;

said resealable elongated heat source chamber being located at a back side of said muff adjacent a body of a user of said device;

said resealable elongated heat source chamber being provided only one opening therein to reduce openings in said heat source chamber;

a reusable heat source inserted in said heat source chamber;

said re-useable heat source comprises a flexible pocket containing a gel and a heat-initiating device which when activated initiates a chemical reaction in said gel which causes said gel to become warm and retain its warmth for hours;

upon initiation of said chemical reaction, said gel is transformed into a hot solid wax condition;

upon depletion of heat from said solid wax condition, said re-useable heat source can be boiled for a predetermined period of time to once again transform the gel into a liquid state for re-use;

permeable insulation material surrounding said heat source chamber and said centrally-located hand warming chamber to allow heat to transfer from said heat source chamber to said hand warming chamber, and to insulate hands of the user from direct contact with said heat source device;

a generally tubular heat reflective layer surrounding said hand warming and heat source chambers the length of the said generally tubular muff;

a human scent lock layer surrounding said generally tubular heat reflective layer;

said human scent lock layer comprises carbon based material;

a pocket located outside of said human scent lock layer;

said pocket runs the length of said heat source chamber;

water resistant insulating material surrounding said human scent lock layer, said pocket, and the entire muff;

an adjustable strap attached to said generally tubular muff to allow an attachment means to the mid section of the body of the user;

a snap within said adjustable strap;

automatic size adjusting hand insert areas at the ends of the said insulated elongated generally tubular hand warming chamber; and said pocket being provided with opening and closing means.

* * * * *